US006307170B1

(12) United States Patent
Oki et al.

(10) Patent No.: US 6,307,170 B1
(45) Date of Patent: Oct. 23, 2001

(54) SEPARATION OF PARTICLES DISPERSED IN LIQUID

(75) Inventors: Tatsuya Oki; Hiroki Yotsumoto, both of Tsukuba (JP)

(73) Assignee: Secretary of Agency of Industrial Science and Technology (JP)

( * ) Notice: Subject to any disclaimer, the term of this patent is extended or adjusted under 35 U.S.C. 154(b) by 0 days.

(21) Appl. No.: 09/487,605

(22) Filed: Jan. 19, 2000

(30) Foreign Application Priority Data

Jan. 20, 1999 (JP) ..... 11-011406

(51) Int. Cl.[7] ..... B03C 7/00
(52) U.S. Cl. ..... 209/127.1; 209/128
(58) Field of Search ..... 209/12.2, 127.1, 209/128, 129, 130

(56) References Cited

U.S. PATENT DOCUMENTS 4,251,353 * 2/1981 Knoll ..... 209/129
4,334,987 * 6/1982 Mamadzhanov et al. .... 209/127.1 X
4,799,452 * 1/1989 Day ..... 209/127.1 X
4,923,581 * 5/1990 Day ..... 209/127.1 X

FOREIGN PATENT DOCUMENTS

787088 * 12/1980 (SU) ..... 209/127.1
1331567 * 8/1987 (SU) ..... 209/127.1

* cited by examiner

*Primary Examiner*—Tuan N. Nguyen
(74) *Attorney, Agent, or Firm*—Lorusso & Loud

(57) ABSTRACT

A device for capturing negatively or positively charged fine particles dispersed in a liquid includes a rotor having an outer surface charged in a polarity opposite to the particles and arranged to be rotated. By rotating the rotor while being maintained in contact with the liquid, the particles are captured on the outer surface thereof. Control of the rotational speed of the rotor makes it possible to selectively separate particles with desired particle sizes.

7 Claims, 4 Drawing Sheets

SEPARATION OF PARTICLES DISPERSED IN LIQUID

BACKGROUND OF THE INVENTION

This invention relates to a method of separating particles dispersed in a liquid and to a device therefor.

Conventional techniques for separating particles dispersed in a liquid include sedimentation, agglomeration with an agglomerating agent and filtration. Sedimentation requires a long time for the separation. The use of an agglomerating agent has a problem because it remains in the liquid phase. Filtration causes a problem of clogging of the filter, especially when the particles have a diameter of 30 $\mu$m or less.

For measuring particle size distribution of a suspended liquid Field Flow Fractionation (FFF) method and Hydrodynamic Chromatography (HDC) are known. These methods, however, cannot separate particles from the suspended liquid.

With a view toward theoretically explaining aggregation and dispersion phenomena in a colloidal dispersion system, DLVO theory has been proposed. Further studies made to develop and modify the DLVO theory results in a method of measuring forces acted between solid particles of mica. No methods are known, however, which can measure a force required for detaching negatively or positively charged particles from an outer surface of a rotor.

SUMMARY OF THE INVENTION

It is, therefore, an object of the present invention to provide a method which can easily separate fine liquid or solid particles dispersed in a liquid.

Another object of the present invention is to provide a method of the above-mentioned type which can selectively separate particles with a desired particle size range.

It is a further object of the present invention to provide a method which can measure a force required for detaching negatively or positively charged particles from an outer surface of a rotor.

It is yet a further object of the present invention to provide a simple device useful for carrying out the above methods.

In accomplishing the foregoing object, there is provided in accordance with one aspect of the present invention a method of separating negatively or positively charged particles dispersed in a liquid, comprising the steps of:

immersing a rotor having an outer surface charged in a polarity opposite to said particles in said liquid; and rotating said rotor to capture said particles on said outer surface.

In another aspect, the present invention provides a method of separating negatively or positively charged particles dispersed in a liquid into a first class of particles having a relatively large particle size and a second class of particles having a relatively small particle size, comprising the steps of:

immersing a cylindrical rotor with a circular cross-section in said liquid, said rotor having an outer surface charged in a polarity opposite to said particles; and rotating said rotor about its axis at a rotational speed sufficient to capture said second class of particles on said outer surface but insufficient to capture said first class of particles on said outer surface.

The present invention further provides a method of measuring a force required for detaching negatively or positively charged particles from an outer surface of a rotor with a circular cross-section, comprising the steps of:

immersing said rotor in a liquid in which said particles are dispersed, said outer surface of said rotor being charged in a polarity opposite to said particles;

rotating said rotor about its axis at a constant rotational speed sufficient to capture some of said particles on said outer surface; and measuring the diameter of that particle which has the largest diameter among the captured particles on said outer surface.

In a further aspect, the present invention provides a device for capturing negatively or positively charged particles dispersed in a liquid, comprising:

a rotor having an outer surface charged in a polarity opposite to said particles and arranged so that said outer surface can be in contact with said liquid; and drive means for rotating said rotor, whereby said particles are captured on said outer surface.

BRIEF DESCRIPTION OF THE INVENTION

Other objects, features and advantages of the present invention will become apparent from the detailed description of the preferred embodiments of the invention which follows, when considered in light of the accompanying drawings, in which.

DETAILED DESCRIPTION OF THE PREFERRED EMBODIMENTS OF THE INVENTION

A method of separating negatively or positively charged particles dispersed in a liquid according to the present invention comprises immersing a rotor, having an outer surface charged in a polarity opposite to said particles, in the liquid. The rotor is rotated so that the particles are captured on the outer surface.

The particle size of the particles is generally in the range of up to 600 $\mu$m, preferably 0.001–500 $\mu$m, more preferably 0.1–100 $\mu$m. The particles are positively or negatively charged liquid particles or solid particles. The medium in which the particles are suspended or emulsified is generally an aqueous medium.

Figure 1:
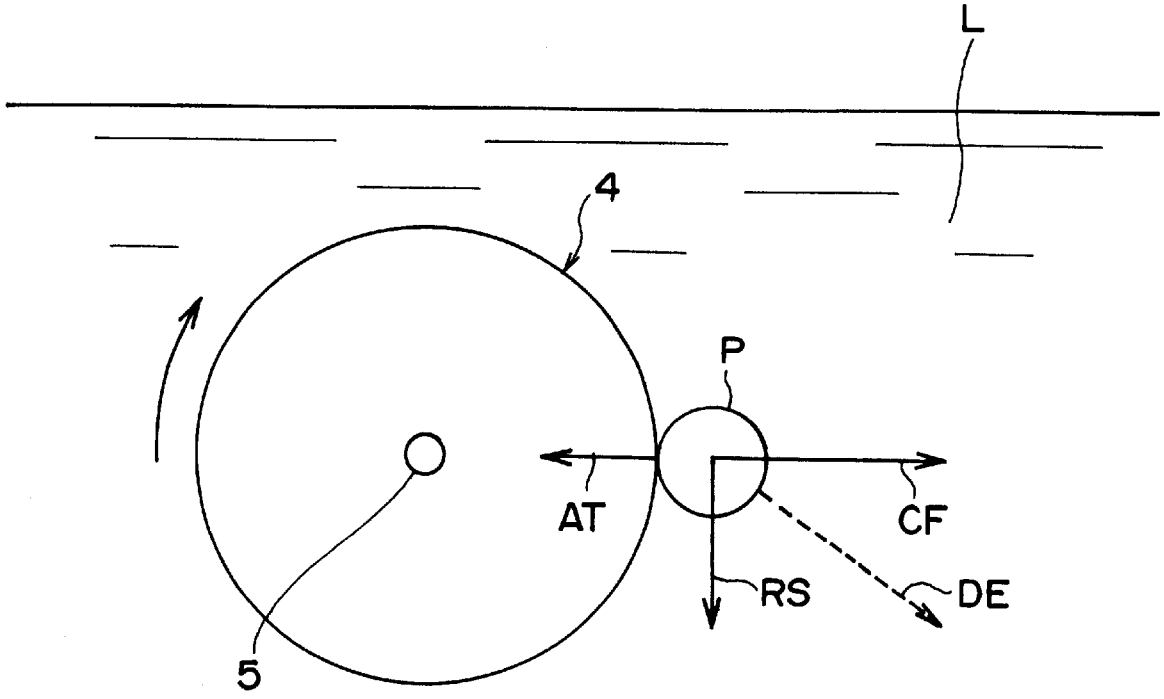
FIG. 1 is a schematic sectional view explanatory of the principle of the separation of particles according to the present invention.

The principle of the above method will be described below with reference to FIG. 1. Designated as 4 is a rotor, such as a cylinder, rotatable about a shaft 5 and immersed in a liquid L. A negatively (or positively) charged particle P is adsorbed on an outer periphery of the rotor 4, charged in a polarity opposite to the particle P, with an attractive force AT.

Because of the rotation of the rotor 4, the particle P receives a centrifugal force CF and a resisting force RS by the liquid L. Designated as DE is a composition of the centrifugal and resisting forces CF and RS. The composite force DE increases with an increase of the rotational speed of the rotor 4 and with an increase of the diameter of the particle P, whereas the attractive force AT is constant irrespective of the size of the particle P, when the charge of the rotor 4 is maintained constant.

Accordingly, at a low rotational speed of the rotor 4, the particle P remains on the rotor 4 even when the particle size thereof is large. However, at a higher rotational speed, the particle P having a large particle size is separated from the surface of the rotor. It is, therefore, possible to selectively adsorb particles having particle sizes smaller than a desired particle diameter by controlling the rotational speed of the rotor 4.

By rotating the rotor 4 about its axis at a constant rotational speed sufficient to capture some of the particles on said outer surface and by measuring the diameter of that particle which has the largest diameter among the captured particles on the outer surface, it is possible to determine a force (DE) required for detaching the particles from the outer surface of the rotor 4. Namely, from the diameter thus measured, it is possible to calculate the centrifugal force CF and the resisting force RS. The composite force DE is then calculated using the centrifugal and resisting forces CF and RS. This force is the same as the minimum attractive force required for keeping the particles adsorbed on the outer surface of the rotor 4. It is desired that the particles have a smooth and wide particle size distribution. The measurement can be made for any kind of the particles.

The rotor 4 is an axially elongated body rotatable about its axis. The cross-sectional area of the rotor 4 is generally constant throughout its length. Thus, a cylindrical (drum) or columnar body is generally used. It is important that the rotor 4 has an outer surface chargeable in a polarity opposite to the charge of the particles.

In one embodiment, the rotor 4 has an outer surface made of a material capable of providing positive or negative interfacial electrokinetic potential (zeta potential), such as resins, inorganic oxides and glass. Illustrative of suitable outer surface materials are metal. oxides such as magnesium oxide, nickel oxide, silicon dioxide (quartz glass) and tungsten oxide, metal hydroxides such as magnesium hydroxide and nickel hydroxide, metal fluoride such as calcium fluoride (florite), paraffin, mica and synthetic plastic materials. The polarity developed on the outer surface depends not only upon the material of the outer surface but also upon the pH of the dispersion, concentration of electrolytes in the dispersion, etc. For example, in the case of a dispersion having a neutral pH and an electroconductivity of about 10 mS/cm (e.g. a dispersion in a medium of a 0.1 M NaCl aqueous solution), an outer surface of a rotor made of magnesium oxide, magnesium hydroxide, nickel hydroxide or florite is positively charged, whereas an outer surface of quartz, paraffin or a plastic is negative charged.

Such a material may be coated on an outer periphery of a suitable substrate to provide the outer surface of the rotor 4. Alternatively, a sheet or film of such a material may be applied, detachably if desired, on an outer periphery of a suitable substrate to provide the outer surface of the rotor 4. When the outer surface layer is detachable from the rotor substrate and is flexible, measurement of the diameter of the particles adsorbed thereon by microscopy can be easily and precisely carried out.

The surface material should be so selected as to provide a negatively charged surface when the particles in the liquid L to be treated are positively charged or a positively charged surface when the particles in the liquid L are negatively charged. The use of the rotor 4 of this type has a merit that a feeder is not required for charging the outer surface thereof and the device has a simple construction.

When the rotor 4 is immersed in the liquid L and rotated, a high desired negative or positive electrokinetic potential is created. As a result, the particles contained in the liquid L are captured by the rotor 4.

Figure 4:
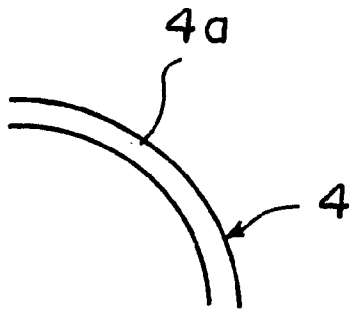
FIG. 4 is a partial schematic illustration of a preferred embodiment of the rotor of the device of the present invention.

In another embodiment, the rotor 4 has an outer surface made of an electrically conductive material and electrically coupled with a feeder (current source). A metal such as copper, molybdenum or palladium may be used as the conductive material. The conductive material may be coated on an outer periphery of a suitable substrate to provide the outer surface of the rotor 4. Alternatively, a sheet or film 4*a* of such a material may be applied, detachably if desired, on an outer periphery of a suitable substrate to provide the outer surface of the rotor 4, as shown in FIG. 4.

A suitable contact such as an electric brush is used to connect the conductive surface and one of the opposite poles of the feeder. An electrode coupled with the other pole of the feeder is disposed in the liquid L, so that the conductive surface is charged when a voltage is impressed between the outer surface and the electrode. It is desired that the voltage be low and/or applied intermittently so as to prevent the liquid L from being electrolyzed.

Preferably, the electrode is made of the same material as the outer surface and is provided on an interior surface of a container for containing the liquid L to be treated. The present embodiment has a merit that the polarity and intensity of the charges on the outer surface of the rotor 4 can be easily changed and controlled.

Figure 5:
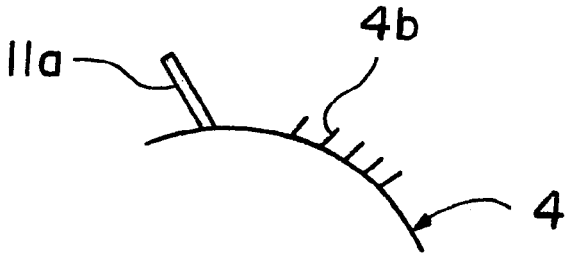
FIG. 5 is a partial schematic illustration of another preferred embodiment of the rotor of the device of the present invention.

For reasons of improved efficiency of adsorbing the particles on the rotor 4, it is preferred that the outer surface of the rotor 4 be provided with a multiplicity of radially outwardly extending needles 4*b*, as illustrated in FIG. 5. The use of such needles 4*b* is especially effective in collecting fine particles contained in the liquid L.

Figure 2:
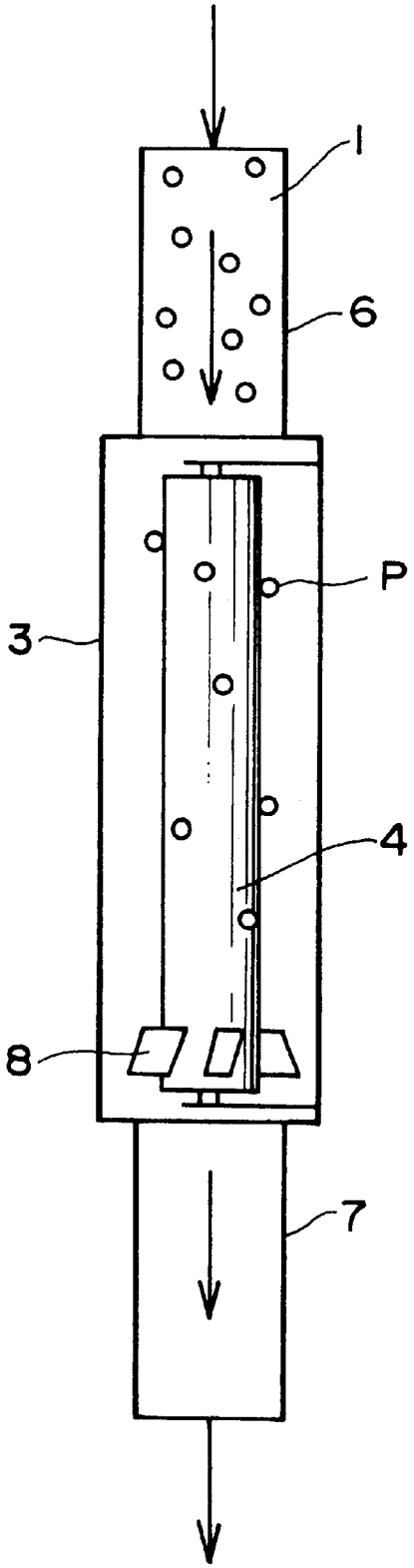
FIG. 2 is an elevational view diagrammatically illustrating one embodiment of a device for separating particles dispersed in a liquid according to the present invention.

The rotor 4 may be rotated with an electric motor. The use of a pulse motor is preferred because the rotational speed can be easily controlled. When the liquid L to be treated is in the form of a stream, the rotor 4 may be rotated with the liquid stream by providing an impeller around a periphery thereof. This embodiment is illustrated in FIG. 2.

Designated as 3 is a tubular housing in which a rotor 4 is rotatably secured. The tubular housing has upper and lower ends to which a feed pipe 6 and a discharge pipe 7 are connected, respectively. The rotor 4 has a lower end portion to which impeller blades are fixed. Thus, when a liquid containing particles is fed through the feed pipe 6 and allowed to flow axially downward through the tubular housing 3, the rotor 3 is rotated. When the rotor 3 has an outer surface made of, for example, a material capable of providing an interfacial electrokinetic potential, the particles P contained in the liquid feed are captured by the rotor 3 depending upon the rotational speed thereof. The rotational speed of the rotor 3 may be controlled by controlling the flow rate of the liquid feed. The illustrated device may be used for separating solid and oil particles from, for example, waste water. The particles adsorbed on the rotor 3 may be removed by scraping with a brush or a blade.

Figure 3:
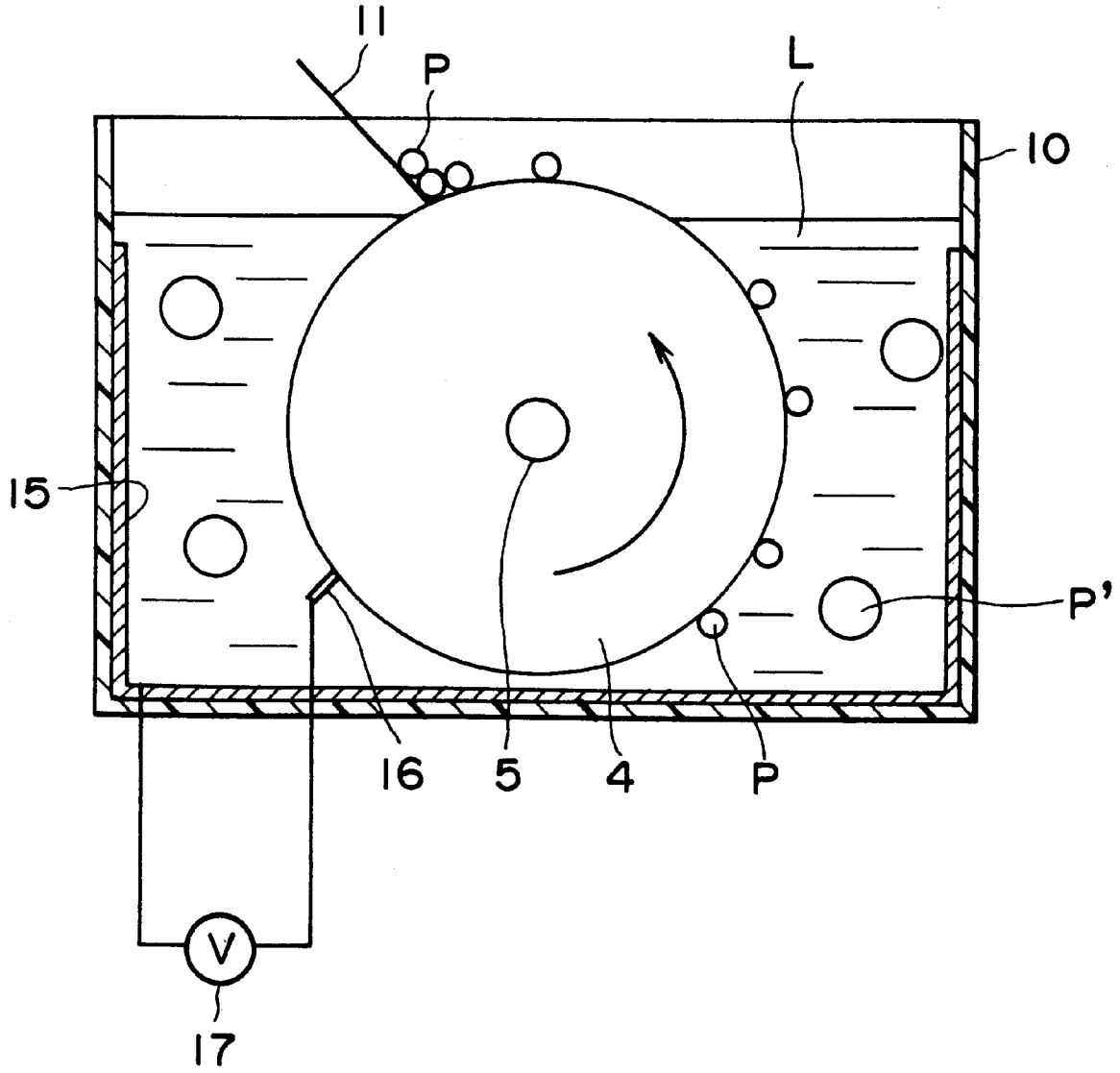
FIG. 3 is a sectional view diagrammatically illustrating an embodiment of a device for separating and collecting particles dispersed in a liquid according to the present invention.

FIG. 3 depicts a device adapted to separate and recover particles P contained in a liquid L. The liquid L in this embodiment contains both relatively small particles P and relatively large particles P' and is stored in a vessel 10. A cylindrical rotor 4 is rotatably disposed in a horizontal position in the liquid L with a part of the periphery thereof being located above the liquid level. The rotor 4 is rotated about a shaft 5 by a pulse motor (not shown). The rotor 4 has an outer peripheral surface made of a conductive material and maintained in electrical contact with a brush electrode 16. The vessel 10 is lined with a conductive material serving as an electrode 15. Both electrodes 15 and 16 are connected to a current source 17 such that the outer surface of the rotor 4 is charged in a polarity opposite to the particles P and P'. A scraper 11 is provided for scraping the particles P carried on the outer surface of the rotor 4 and traveling above the level of the liquid.

Upon rotation of the rotor 4 at a selected rotational speed, the small particles P are selectively captured by the rotor 4. The captured particles P are successively scraped with the scraper 11 and recovered. When the outer surface of the rotor 4 is provided with a multiplicity of needles, the scraper should be in the form of a brush. The removal of the captured particles P from the outer surface of the rotor 4 may be facilitated when the surface above the liquid level is charged with a charger so as to have the same polarity as that of the particles P.

Using the above-described device, particles with desired particle size range can be selectively and continuously collected by controlling the rotational speed of the rotor 4. Thus, the device according to the present invention can be used for many fields as a substitute for a filter or other known classifying or liquid-solid separation devices.

The following examples will further illustrate the present invention.

EXAMPLE 1

A suspension containing positively charged iron oxide particles having a particle size ranging up to 10 $\mu$m and dispersed in an aqueous medium having a pH of less than 6 was contained in a vessel. A cylindrical rotor made of polypropylene and having an outer diameter of 2 cm was immersed in the above suspension in a horizontal position. The rotor was rotated at a constant speed of 120 rpm. Iron oxide particles having particle size of 2 $\mu$m or less were found to be selectively captured on the rotor surface.

What is claimed is:

1. A device for capturing negatively or positively charged particles dispersed in a liquid, comprising:

a rotor in the form of a cylinder having a circular cross-section and defining a central, horizontally oriented axis, said rotor having an outer cylindrical surface charged in a polarity opposite to the particles and arranged so that a lower portion of said outer surface is in contact with said liquid and an upper portion of said outer surface is positioned above surface level of said liquid;

drive means for rotating said rotor, whereby said particles are captured on and carried by said outer surface; and a scraper positioned for removing, by scraping, the particles carried by said outer surface above the level of said liquid.

2. A device as claimed in claim 1, wherein said drive means includes an impeller secured to said rotor for rotatable therewith so that said impeller is rotated when disposed in a stream of said liquid.

3. A device as claimed in claim 1, wherein said drive means includes an electric motor.

4. A device as claimed in claim 1, wherein said cylinder has a detachable surface layer providing said outer surface.

5. A device as claimed in claim 1, wherein said outer surface is made of a material providing an electrokinetic potential.

6. A device as claimed in claim 1, wherein said outer surface is made of an electrically conductive material, said device further comprising an electric source electrically coupled with said outer surface, and an electrode disposed in said liquid.

7. A device as claimed in claim 1, wherein said outer surface is provided with a multiplicity of radially outwardly extending needles.

* * * * *

UNITED STATES PATENT AND TRADEMARK OFFICE

CERTIFICATE OF CORRECTION

PATENT NO. : 6,307,170 B1
DATED : October 23, 2001
INVENTOR(S) : Oki et al.

It is certified that error appears in the above-identified patent and that said Letters Patent is hereby corrected as shown below:

Column 3,
Line 58, “negative” should read -- negatively --

Column 4,
Line 56, “rotor 3” both instances should read -- rotor 4 --
Line 59, “rotor 3” should read -- rotor 4 --
Line 61, “rotor 3” should read -- rotor 4 --
Line 64, “rotor 3” should read -- rotor 4 --

Column 6,
Lines 22-23, “rotatable” should read -- rotation --

Signed and Sealed this

Second Day of July, 2002

*Attest:*

*Attesting Officer*

JAMES E. ROGAN
*Director of the United States Patent and Trademark Office*